United States Patent [19]

Dodwell et al.

[11] 4,233,074

[45] Nov. 11, 1980

[54] PHOTOGRAPHIC POLYESTER FILM BASE WITH SUBBING LAYER CONTAINING PHOSPHORIC ACID DERIVATIVE

[75] Inventors: Geoffrey M. Dodwell; Norman E. Gambles, both of Brentwood, England

[73] Assignee: Ciba-Geigy Aktiengesellschaft, Basel, Switzerland

[21] Appl. No.: 914,813

[22] Filed: Jun. 12, 1978

[30] Foreign Application Priority Data

Jun. 24, 1977 [GB] United Kingdom ..... 26504/77

[51] Int. Cl.[2] ..... G03C 1/78

[52] U.S. Cl. ..... 430/535; 430/529; 427/175

[58] Field of Search ..... 427/175; 96/87 R, 87 A, 96/114.2

[56] References Cited

U.S. PATENT DOCUMENTS

| | | | |
|---|---|---|---|
| 3,635,714 | 1/1972 | Oshibuchi et al. | 96/87 A |
| 3,658,573 | 4/1972 | Guestaux et al. | 96/87 A |
| 3,733,215 | 5/1973 | Van Paesschen et al. | 96/87 A |
| 3,856,530 | 12/1974 | Van Paesschen et al. | 96/87 R |
| 3,895,950 | 7/1975 | Gieger et al. | 96/87 A |
| 3,911,172 | 10/1975 | Van Paesschen et al. | 96/87 R |
| 3,998,157 | 10/1976 | Van Paesschen et al. | 96/87 R |
| 4,001,023 | 1/1977 | Van Paesschen et al. | 96/87 R |
| 4,089,997 | 5/1978 | Van Paesschen et al. | 96/87 R |

FOREIGN PATENT DOCUMENTS 1463727 2/1977 United Kingdom .

*Primary Examiner*—Jack P. Brammer

[57] ABSTRACT

Provided is a method of preparing film base material consisting of biaxially oriented synthetic linear polyester which comprises stretching extruded synthetic polyester material in one direction and then coating on this material a copolymer in form of an aqueous latex of vinylidene chloride, a plasticising comonomer for the vinylidene chloride and optionally other comonomers together with 10 to 40 percent by weight of solids in the latex of at least one phosphoric acid derivative of the formula

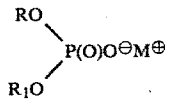

wherein M is hydrogen, ammonium or an alkali metal, R is methyl, ethyl or an ethylene oxide and/or propylene oxide units containing group, and $R_1$ is hydrogen, methyl or ethyl, drying this coating and completing the orientation of the polyester film material.

A photographic silver halide emulsion can be coated directly on this base without the need to apply any intermediate gelatin subbing layer. The adhesion between the film base and the photographic emulsion layers is improved and further the separation or frilling of these layers when the final photographic film is processed can be avoided. Due to the also improved surface conductivity of the film base there is no need for a separate antistatic layer.

16 Claims, No Drawings

PHOTOGRAPHIC POLYESTER FILM BASE WITH SUBBING LAYER CONTAINING PHOSPHORIC ACID DERIVATIVE

This invention relates to synthetic film materials, and more particularly to film base materials of use in the production of photographic materials.

It is known that self-supporting films formed of synthetic linear polyesters, particularly of the polyesters formed by reaction of ethylene glycol and terephthalic acid, may be prepared with mechanical and physical and chemical properties which, for example, render them very suitable indeed as base materials on which may be coated silver halide photographic emulsion layers for the production of photographic film materials.

However, since such base materials are inherently highly hydrophobic and the usual gelatino silver halide emulsions are highly hydrophilic, there is great difficulty in securing adequate anchorage between the base film and the emulsion layer, especially bearing in mind that the anchorage must remain firm throughout the processing sequence of the final photographic film.

It is known to deal with such a difficulty by the provision of an anchoring layer or layers (so called "subbing" layers) between the film base and the emulsion layer, but the polyester base has to be in a layer receptive state before a subbing layer can be coated thereon (British Pat. Specification No. 1 463 727). Polyester film material has to be biaxially oriented, that is to say stretched in two directions at right angles, before it can be used as film base. Polyester base before it has been oriented or when it has been oriented in one direction only is in a layer receptive state, and thus a subbing layer can be coated on the base before full orientation has taken place. Alternatively after the polyester base has been fully oriented it may be made layer receptive by treating it with a corona discharge or by coating on it a phenolic adhesion promoting solvent such as m-cresol. This last method is more expensive than the method in which the polyester film base material is prepared by coating the subbing layer at the inter-draw stage before full orientation of the base because more process steps are required and both corona discharge and phenolic adhesion promoting solvents have been shown to produce undesirable side-effects in subsequently applied layers. However the method wherein the subbing layer is coated on the polyester film material at the inter-draw stage before full orientation suffers from the drawback that a gelatin layer has to be coated on the subbing layer after full orientation and before a silver halide emulsion layer can be coated thereon in order to ensure that the adhesion of the silver halide emulsion layer is satisfactory during subsequent processing of the thus prepared photographic material.

We have now discovered a method of preparing polyester film base material in which a subbing layer is applied at the inter-draw stage but which does not require a gelatin subbing layer to be applied thereto before a silver halide emulsion layer is coated thereon.

Therefore according to the present invention there is provided a method of preparing film base material consisting of biaxially oriented synthetic linear polyester which comprises stretching extruded synthetic polyester material in one direction and then coating on this material a copolymer in form of an aqueous latex of vinylidene chloride, a plasticising comonomer for the vinylidene chloride and optionally other comonomers together with 10 to 40 percent by weight of solids in the latex of at least one phosphoric acid derivative (phosphates, phosphoric acid esters) of the formula

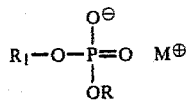

(1)

wherein M is an alkali metal, ammonium or hydrogen, $R_1$ is methyl, ethyl or hydrogen and R is methyl, ethyl or an ethylene oxide group of the formula $-(CH_2CH_2O)_nR_2$ or a propylene oxide group of the formula

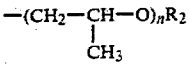

where $R_2$ in each case is alkyl or optionally substituted acyl, aryl or aralkyl and n is 1 to 20, or a mixed ethylene oxide/propylene oxide group of the formula

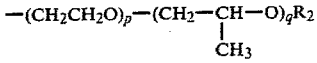

where the ethylene oxide and propylene oxide moieties are arranged either in blocks or randomly in the chain and the sum of p and q is n, drying this coating and completing the orientation of the polyester film material.

Compounds of formula (1) are often only available as mixtures due to their method of preparations. However a mixture of compounds of formula (1) is just as effective in the method of the present invention as a singly compound of formula (1) although as hereinafter stated the use of certain compounds of formula (1) is preferred.

Phosphoric acid derivatives of formula (1), wherein M is hydrogen, ammonium or an alkali metal, $R_1$ is methyl, ethyl or hydrogen and R is methyl or ethyl are preferred.

A photographic silver halide emulsion can be coated directly on this base without the need to apply any intermediate gelatin subbing layer.

Therefore according to a preferred aspect of the present invention there is provided a method of preparing photographic silver halide material which comprises at least one layer of silver halide emulsion coated on biaxially oriented synthetic linear polyester which comprises stretching extruded synthetic polyester material in one direction and then coating on this material a copolymer in form of an aqueous latex of vinylidene chloride, a plasticising comonomer for the vinylidene chloride and optionally other comonomers together with 10 to 40 percent by weight of solids in the latex of a phosphoric acid derivative of the formula (1), drying this coating and completing the orientation of the polyester material and then coating on the fully subbed and fully oriented polyester base a photographic silver halide emulsion.

Usually the photographic silver halide emulsion is a gelatino silver halide emulsion but it may be a mixture of gelatin and other natural or synthetic hydrophilic colloids or consist of other natural and/or synthetic colloids without any gelatin present. Examples of such colloids are albumin, casein, polyvinyl alcohol and polyvinyl pyrrolidone.

The preferred amount of a compound of formula (1) to be present in the latex is from 20 to 30 parts per hundred solids in the latex. All the compounds of the formula (1) are water soluble compounds.

The phosphoric acid esters of formula (1) have been used in photographic materials as anti-static agents (British Pat. Specification No. 687 399) but is was an entirely unexpected discovery that these compounds when used in the method of the present invention would exhibit adhesion promoting properties. As shown in the Example when a similar method of preparing photographic silver halide material as the method of the present invention is carried out wherein no phosphoric acid ester of formula (1) is present in the aqueous latex applied to the polyester at the inter-draw stage then the subsequently applied silver halide emulsion layer exhibits very poor adhesion to the base.

The preferred compounds of formula (1) are phosphates of formula

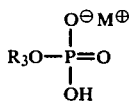

(2)

where $R_3$ is ethyl or

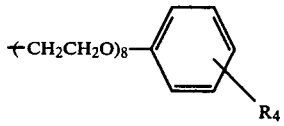

where $R_4$ is alkyl, of 1 to 12 carbon atoms for example, and M is sodium or potassium.

The comonomers of use in the present invention comprise vinylidene chloride and a comonomer which has a plasticising effect on vinylidene chloride that is to say it renders vinylidene chloride less crystalline and thus improves its film forming properties.

The preferred plasticising comonomers are lower alkyl (i.e. 1–6 carbon atoms) acrylate and methacrylate esters, for example methyl methacrylate and methyl acrylate, also acrylonitrile.

Other comonomers, units of which may be present in the copolymer are acids, for example acrylic acid, methacrylic acid, itaconic acid, maleic acid, crotonic acid, mesaconic acid and citraconic acid. Yet other comonomers, units of which may be present in the copolymer are comonomers which contain an active halogen group and are of the formula

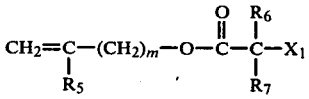

(3)

wherein m is 0 or 1, $R_5$ is a hydrogen atom or a methyl group when m is 1 but is a hydrogen atom when m is 0, $X_1$ is a bromine or chlorine atom and $R_6$ and $R_7$ are each a hydrogen atom or a methyl group or are the same halogen atom as $X_1$, or a vinyl component containing an active halogen group of the formula

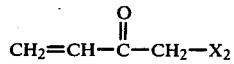

(4)

wherein $X_2$ is a chlorine or bromine atom.

Formula (3) covers two classes of monomers: allyl or methallyl halogeno esters of the formula

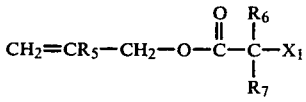

(5)

and vinyl halogeno esters of the formula

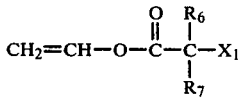

(6)

wherein in the above formulae (5) and (6) $R_5$, $R_6$, $R_7$ and $X_1$ have the meanings given to them above.

The preferred monomers of formula (5) for use in the copolymer of use in the present invention are those wherein $R_5$ is a hydrogen atom and $X_1$ is chlorine. The most preferred monomer is allyl monochloroacetate.

The preferred monomers of formula (6) for use in the copolymer of use in the present invention are those wherein $X_1$ is chlorine and the most preferred monomer is vinyl monochloroacetate which is available commercially.

The allyl or methallyl halogeno esters of formula (5) may be prepared by reacting allyl or methallyl alcohol with the appropriate halocarboxylic acid.

The vinyl halogenoesters of formula (6) may be prepared by reacting acetylene with the appropriate halocarboxylic acid in the presence of a catalyst, for example mercuric oxide or by the transvinylation reaction between vinyl acetate and the appropriate halocarboxylic acid.

The halomethyl vinyl ketones of formula (4) may be prepared by the method of Cath et al, J. Chem. Soc. 1948 page 278.

The monomers are described for example in British Pat. Specification No. 1 463 727.

Preferably the copolymer comprises from 20 to 95% by weight of vinylidene chloride and at least 5% by weight of the plasticizing comonomer. Suitable copolymers comprise from 20 to 95% by weight of vinylidene chloride, from 5 to 50% by weight of plasticising comonomer, 0 to 20% by weight of copolymerisable acid and 0 to 25% by weight of other comonomers.

Especially suitable copolymers comprise from 80 to 90% by weight of vinylidene chloride, from 7 to 20% by weight of lower alkyl acrylate or methacrylate, from 0 to 3% by weight of itaconic acid and from 0 to 20% by weight of a comonomer having an active halogen group.

Examples of suitable copolymers are those which contain 81% of vinylidene chloride, 7.7% of methyl acrylate, 9.4% of allyl monochloroacetate and 1.9% of itaconic acid; or 90% of vinylidene chloride, 8.0% of methyl acrylate and 2.0% of itaconic acid; or 81% of vinylidene chloride, 7.8% of methyl acrylate, 9.5% of allyl dichloroacetate and 1.7% of itaconic acid (all percentages by weight). The preparation of these copolymers is set forth hereinafter.

Other suitable copolymers are copolymers of vinylidene chloride with vinyl chloride and optionally other comonomers. Examples of other comonomers which may be present are the monomer acids as hereinbefore set forth and monomers having an active halogen group as hereinbefore mentioned.

Examples of particularly suitable copolymers based on vinylidene chloride/vinyl chloride are those which contain 50% by weight of vinylidene chloride and 50% by weight of vinyl chloride.

The following preparations illustrate the preparation of the copolymers used in the Examples which follow. Parts and percentates are by weight.

Preparation 1

To 240 ml of de-oxygenated water 80 ml of vinylidene chloride, 10 ml of methyl acrylate, 10 ml of allyl monochloroacetate, 2.25 g of itaconic acid, 1 g of sodium metabisulphite, 1 g of sodium persulphate, 0.2 g of an adduct of the formula

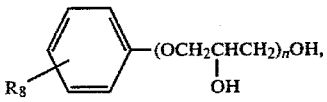

(101)

wherein $R_8$ is octyl or nonyl and n is an integer of 6 to 10, 0.9 g of sodium octylphenyl poly-(oxyethylene)-sulphate (average 8.5 ethylene oxide units) were added and the mixture was stirred at 25° C. during polymerisation under nitrogen.

This copolymer contains 81% of vinylidene chloride, 7.7% of methyl acrylate, 8.4% of allyl monochloroacetate and 1.9% of itaconic acid. The copolymer is prepared as a latex. (copolymer 1)

Preparation 2

A latex was prepared as in Preparation 1 but the quantities of monomers added were as follows:

vinylidene chloride: 80 ml
methyl acrylate: 10 ml
itaconic acid: 2.25 g

The resulting copolymer contains 90% of vinylidene chloride, 8.9% of methyl acrylate and 2.0% of itaconic acid.

The latex copolymer of this preparation is designated copolymer 2.

Preparation 3

A latex was prepared as in Preparation 1 but the quantities of monomers added were as follows:

vinylidene chloride: 80 ml
methyl acrylate: 10 ml
allyl dichloroacetate: 10 ml
itaconic acid: 2 g The resulting copolymer contains 81% of vinylidene chloride, 7.8% of methyl acrylate, 9.5% of allyl dichloroacetate and 1.7% of itaconic acid.

The latex copolymer of this preparation is designated copolymer 3.

The following Example will serve to illustrate the invention:

EXAMPLE

Poly-(ethylene terephthalate) chips were melted and extruded at 280° C. onto a chilled mirror finish drum and then stretched longitudinally by a factor of 3 by capstan rollers of increasing circumferential speed to produce uniaxially oriented polyester, upon which the coatings as set forth below were made by a roller applicator. After passing the coating head the film was heated to between 80° to 120° C. to dry the coating and then stretched laterally in a stenter apparatus to a ratio of 3 prior to being heat set while still under tension at 180° to 220° C. The film was then trimmed and reeled up.

Individual lengths of the polyester film produced as above were coated at the interdraw stage by roller applicator with the following latex mixtures.

Coating 1 latex of copolymer 1: 142 ml (50 g of solid)
methyl methacrylate particles (anti-block agent): 5 g
adduct of the formula (101): 5 ml
(5% aqueous solution, coating aid): (0.25 g solid)
ethyl phosphoric acid (compound of formula (1): 15 g The coating was carried out in such a manner that an even film of 1.5 mg/dm$^2$ (dry weight) of the copolymer mixture was deposited on the substrate.

Coating 2

The coating was made as coating 1 but no ethyl phosphoric acid was added. This is therefore outside the present invention:

latex of copolymer 1: 142 ml
methyl methacrylate particles (anti-block agent): 5 g
coating aid (5% solution): 5 ml.

Coating 3

The coating was made as coating 1 with the assembly as follows:

latex copolymer 2: 148 ml (50 g of solid)
methyl methacrylate particles (anti-block agent): 5 g
coating aid (5% solution): 5 ml
potassium ethyl hydrogen
phosphate: 15 g.

Coating 4

The coating was made as coating 1 with the assembly as follows:

latex copolymer 3: 153 ml (50 g of solid)
methyl methacrylate particles (anti-block agent): 5 g
coating aid (5% solution): 5 ml
mixture of potassium ethyl hydrogen phosphate: 6.5 g
diethyl phosphoric acid: 6.5 g.

Coating 5

The coating was made as above with the assembly as follows:

| | | |
|---|---|---|
| latex copolymer 2 | 148 | ml (50 g of solid) |
| methyl methacrylate particles (anti-block agent) | 5 | g |
| coating aid (5% solution) | 5 | ml |
| sodium alkyl aryl poly(ethylene oxide)-phosphate of the formula | — | |
| 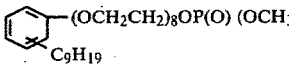  | 12.5 | g |

Coating 6

The coating was made as coating 1 with the assembly as follows:

latex copolymer 3: 153 ml (50 g of solid)
methyl methacrylate particles (anti-blocking agent): 5 g
coating acid (5% solution): 5 ml
sodium methyl hydrogen phosphate: 15 g.

Thus coatings 1 and 3 to 6 have been prepared by the method of the present invention but coating 2 has been prepared by a method outside the present invention because no phosphate compounds of formula (1) were present in the latex which was used to coat the base at the inter-draw stage.

An aqueous gelatino silver halide emulsion was then coated onto all the coatings 1 to 6 and then dried.

The coatings were then tested for dry and wet adhesion.

Two types of adhesion are important the first is dry adhesion. This adhesion relates to the copolymer on the base and to the hydrophilic layer coated on the copolymer layer, the object of subbing being of course to enable the hydrophilic layer to remain firmly adherent on to the hydrophobic film base. The hydrophilic layer may be an anti-halation backing layer or a photosensitive layer e.g. a silver halide emulsion layer. It is important that other layers remain firmly anchored to the base when the film material is finished, i.e. cut up into small strips and enclosed in cassettes or spooled up. Further it is important that the hydrophilic layers do not frill off when the film is placed in the camera or when removed from the camera.

There are no recognised standard dry adhesion tests. However the following test was carried out on strips of the sets of samples as prepared above each of which had coated with a silver halide emulsion layer.

| | Tear test strip torn followed by tearing off an adhesive tape put over tear edge. | | | | |
|---|---|---|---|---|---|
| Effect Observed. | No Fringe. | Small stripped fringe. | Large stripped fringe. | Large areas peeled away. | Whole coating peels off. |
| Arbitrary Grade. | 1 | 2 | 3 | 4 | 5 |

| Results of Tear test | | |
|---|---|---|
| | Arbitrary Grade | Surface Resistivity of Base (ohms per sq. at 60% RH). |
| Coating 1 | 1 | $10^{11}$ |
| 2 | 4 | $>10^{13}$ |
| 3 | 1 | $10^{9}$ |
| 4 | 1 | $10^{9}$ |
| 5 | 1 | $10^{10}$ |
| 6 | 1 | $10^{10}$ |

This shows that the adhesion of coatings 1 and 3 to 6 which were prepared by the method of the present invention exhibited satisfactory dry adhesion. It also shows that the presence of the phosphate improved considerably the surface resistivity of the film base.

Coatings 1 to 6 were then tested for wet adhesion.

The film base of the present invention is of particular use as photographic film base in which case at least one photographic silver halide emulsion layer is coated on the subbed film base.

Such photographic film material is usually processed in a sequence of aqueous processing baths and it is very important that all the final image layer is retained firmly on to the base.

A typical processing sequence comprises immersion in the listed aqueous baths in the period states, alkaline developer bath 1 minute, acid fix bath 1 minute, aqueous washing in circulating water 5 minutes, followed by hot air drying.

The coatings were subjected also to a scratch/rub test during each stage of wet processing this consisted of making scratch marks in the coating on the film while still wet and then rubbing the film surface perpendicular to the scratch.

In developer, stop and fix these were done every 10 seconds while in water it was done every minute.

| Wet tests | | | | |
|---|---|---|---|---|
| Effecct observed. | No peeling of emulsion. | Some peeling. | Areas of emulsion lift. | All emulsion lifts away. |
| Arbitrary Grade | 1 | 2 | 3 | 4 |
| Results of Wet Adhesion Test Arbitrary Grade. | | | | |
| Coating 1 | 1 | | | |
| 2 | 4 | | | |
| 3 | 1 | | | |
| 4 | 1 | | | |
| 5 | 1 | | | |
| 6 | 1 | | | |

This shows that coatings 1 and 3 to 6 which had been prepared according to the present invention also exhibited satisfactory wet adhesion whilst the other strip not prepared by the method of the present invention did not exhibit satisfactory wet adhesion.

The invention also includes polyester film base material prepared by the method of the present invention and photographic silver halide material prepared by the method of the present invention.

What we claim is:

1. A method of preparing film base material consisting of biaxially oriented synthetic linear polyester which comprises stretching extruded synthetic polyester material in one direction and then coating on this material a copolymer in the form of an aqueous latex consisting essentially of (a) 20 to 95% by weight of vinylidene chloride;
(b) 5 to 50% by weight of a plasticising comonomer selected from the group consisting of (1) an alkyl acrylate or methacrylate, where the alkyl moiety contains 1 to 6 carbon atoms (2) acrylonitrile and (3) vinyl chloride;
(c) 0 to 20% by weight of a copolymerisable acid; and
(d) 0 to 25% by weight of other comonomers different from (a) to (c) together with 10 to 40 percent by weight of solids in the latex of at least one phosphoric acid derivative of the formula

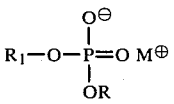

wherein M is an alkali metal, ammonium or hydrogen, $R_1$ is methyl, ethyl or hydrogen and R is methyl, ethyl or an ethylene oxide group of the formula $-(CH_2CH_2O)_nR_2$ or a propylene oxide group of the formula $$-(CH_2-\underset{\underset{CH_3}{|}}{CH}-O)_nR_2$$

wherein $R_2$ in each case is alkyl or optionally substituted acyl, aryl or aralkyl and n is 1 to 20, or a mixed ethylene oxide/propylene oxide group of the formula $$-(CH_2CH_2O)_p-(CH_2-\underset{\underset{CH_3}{|}}{CH}-O)_qR_2$$

where the ethylene oxide and propylene oxide moieties are arranged either in blocks or randomly in the chain and the sum of p and q is n, drying this coating and completing the orientation of the polyester film material.

2. A method of preparing photographic silver halide material which comprises at least one layer of silver halide emulsion coated on biaxially oriented synthetic linear polyester which comprises stretching extruded synthetic polyester material in one direction and then coating on this material a copolymer in form of an aqueous latex according to claim 1, drying this coating and completing the orientation of the polyester material and then coating on the fully subbed and fully oriented polyester base a photographic silver halide emulsion.

3. A method according to claim 2, wherein the silver halide emulsion is a gelatino silver halide emulsion.

4. A method according to claim 1, wherein the amount of the phosphoric acid derivative present in the latex is from 20 to 30 parts per hundred solids in the latex.

5. A method according to claim 1, wherein the phosphoric acid derivative is a phosphate of the formula $$R_3O-\overset{\overset{O^{\ominus}M^{\oplus}}{|}}{\underset{\underset{OH}{|}}{P}}=O$$

where $R_3$ is ethyl or

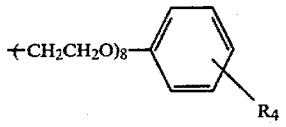

where $R_4$ is an alkyl group and M is sodium or potassium.

6. A method according to claim 1, wherein the plasticising comonomer is an alkyl acrylate or methacrylate ester where the alkyl moiety comprises from 1 to 6 carbon atoms or acrylonitrile.

7. A method according to claim 1, wherein (c) is a comonomer selected from acrylic acid, methacrylic acid, itaconic acid, maleic acid, crotonic acid, mesaconic acid and citraconic acid.

8. A method according to claim 1, wherein (d) is a comonomer which contains an active halogen group of the formula $$CH_2=\underset{\underset{R_5}{|}}{C}-(CH_2)_m-O-\overset{\overset{O}{||}}{C}-\overset{\overset{R_6}{|}}{\underset{\underset{R_7}{|}}{C}}-X_1$$

wherein m is 0 or 1, $R_5$ is a hydrogen atom or a methyl group when m is 1 but is a hydrogen atom when m is 0, $X_1$ is a bromine or chlorine atom and $R_6$ and $R_7$ are each a hydrogen atom or a methyl group or are the same halogen atom as $X_1$, or a vinyl component containing an active halogen group of the formula $$CH_2=CH-\overset{\overset{O}{||}}{C}-CH_2-X_2$$

wherein $X_2$ is a chlorine or bromine atom.

9. A method according to claim 1, wherein the copolymer comprises from 80 to 90% by weight of vinylidene chloride, from 7 to 20% by weight of lower alkyl acrylate or methacrylate, from 0 to 3% by weight of itaconic acid and from 0 to 20% by weight of a comonomer having an active halogen group.

10. A method according to claim 1, wherein the plasticising comonomer is vinyl chloride.

11. A method according to claim 10, wherein the copolymer comprises 50% by weight of vinylidene chloride and 50% by weight of vinyl chloride.

12. A method according to claim 10, wherein the copolymer comprises units of at least one copolymerisable acid selected from acrylic acid, methacrylic acid, itaconic acid, maleic acid, crotonic acid, mesaconic acid and citraconic acid and optionally units of a comonomer of the formula $$CH_2=\underset{\underset{R_5}{|}}{C}-(CH_2)_m-O-\overset{\overset{O}{||}}{C}-\overset{\overset{R_6}{|}}{\underset{\underset{R_7}{|}}{C}}-X_1$$

wherein m is 0 or 1, $R_5$ is a hydrogen atom or a methyl group when m is 1 but is a hydrogen atom when m is 0, $X_1$ is a bromine or chlorine atom and $R_6$ and $R_7$ are each a hydrogen atom or a methyl group or are the same halogen atom as $X_1$, or a vinyl component containing an active halogen group of the formula $$CH_2=CH-\overset{\overset{O}{||}}{C}-CH_2-X_2$$

wherein $X_2$ is a chlorine or bromine atom.

13. Film base material prepared according to the method of claim 1.

14. Photographic silver halide material prepared according to the method of claim 2.

15. A process of claim 1 wherein the phosphoric acid derivative of claim 1 is ethyl phosphoric acid.

16. A process of claim 1 wherein methyl methacrylate is the plasticizing comonomer.

* * * * *